US009452634B1

(12) United States Patent
Mock

(10) Patent No.: US 9,452,634 B1
(45) Date of Patent: Sep. 27, 2016

(54) WRITING INSTRUMENT

(71) Applicant: Craig C. Mock, Dodge City, KS (US)

(72) Inventor: Craig C. Mock, Dodge City, KS (US)

( * ) Notice: Subject to any disclaimer, the term of this patent is extended or adjusted under 35 U.S.C. 154(b) by 95 days.

(21) Appl. No.: 14/532,924

(22) Filed: Nov. 4, 2014

(51) Int. Cl.

| | |
|---|---|
| ***B43K 5/16*** | (2006.01) |
| ***B43K 7/12*** | (2006.01) |
| ***B43K 24/00*** | (2006.01) |
| ***B43K 7/00*** | (2006.01) |
| *B43K 24/06* | (2006.01) |

(52) U.S. Cl.
CPC ..... *B43K 7/005* (2013.01); *B43K 7/12* (2013.01); *B43K 5/16* (2013.01); *B43K 24/06* (2013.01)

(58) Field of Classification Search
CPC ..... B43K 5/16; B43K 7/12; B43K 23/004; B43K 23/008; B43K 23/012; B43K 24/00; B43K 24/02; B43K 24/06
USPC ..... 401/6, 7, 48, 71, 75, 79, 99, 116, 251
See application file for complete search history.

(56) References Cited

U.S. PATENT DOCUMENTS

| | | | | |
|---|---|---|---|---|
| 1,367,872 A | | 2/1921 | Glaesser | |
| 4,200,403 A | * | 4/1980 | Chu | B43K 7/005 401/116 |
| 4,508,464 A | | 4/1985 | Money | |
| 4,568,213 A | | 2/1986 | Money | |
| 5,413,428 A | | 5/1995 | Kageyama | |
| 6,464,419 B1 | | 10/2002 | Chan | |

OTHER PUBLICATIONS

U.S. Appl. No. 14/053,138, filed Oct. 14, 2013, Mock.

* cited by examiner

*Primary Examiner* — David Walczak
*Assistant Examiner* — Joshua Wiljanen
(74) *Attorney, Agent, or Firm* — Kenneth H. Jack; Davis & Jack, L.L.C.

(57) ABSTRACT

A writing instrument incorporating a plurality of knuckles arranged in a longitudinal series; a tube member and scribing pen combination extending through the knuckles wherein the scribing pen is mounted within the tube member and has a longitudinal scribing end; and incorporating first and second leaves, each leaf among the first and second leaves having proximal and distal ends, the first and second leaves being connected operatively to the knuckles for movement between closed and opened positions, the distal ends being adjacent each other upon movements of the first ad second leaves to their closed positions, the distal ends being displacing circumferentially from each other upon movements of the first and second leaves toward their opened positions.

7 Claims, 6 Drawing Sheets

WRITING INSTRUMENT

REFERENCE TO PREVIOUSLY FILED AND CO-PENDING APPLICATION COMMONLY OWNED BY THE INSTANT INVENTOR AND APPLICANT

The inventor and applicant in the instant application is the same person as the inventor and applicant in U.S. patent application Ser. No. 14/053,138 filed Oct. 14, 2013, and entitled "Writing Instrument". Said previously filed patent application remains pending at the date of filing of the instant application.

FIELD OF THE INVENTION

This invention relates to writing instruments such as pens, markers, and pencils. More particularly, this invention relates to such writing instruments whose body portions are adapted for ergonomic grasping and holding by the fingers of a writer's hand.

BACKGROUND OF THE INVENTION

Common pens and pencils having a barrel shaped or cylindrical body are often grasped by the thumb, index, and middle fingers of a writer's hand. During such use, the tip of the index finger, the tip of the thumb, and the proximally lateral side of the writer's middle finger are typically placed over contact points arrayed at approximately 120 degree intervals about the cylindrical body of the instrument. Such common writing instrument holding technique, when applied to a common cylinder bodied pen undesirably and unergonomically allows the body of the pen to roll over the contact points resulting in undesirable pen instability during writing.

The instant inventive writing instrument solves or ameliorates the problems, difficulties, and deficiencies of common barrel body pens and pencils described above, by specially configuring the pen's body to define a pair of hinge leaves which pivotally move about a series of hollow bored hinge knuckles, the hinge leaves being capable of alternately moving between a compact and collapsed closed non-use position and opened and substantially triangular cross-sectional writing configuration. The special configuration of the instant invention incorporates scribing means such as a pen or pencil which extends within and through aligned bores of the hinge knuckles. The special configuration preferably further incorporates extending and retracting means which operatively move the scribing hinge pin and are actuated by pivoting motions of the instrument's hinge leaf body portions.

BRIEF SUMMARY OF THE INVENTION

A first structural component of the instant inventive writing instrument comprises a plurality of hollow bored knuckle or sleeve components which are arranged in a longitudinally extending series. In the preferred embodiment, the knuckle components are configured similarly with the series of hinge pin receiving sleeves or knuckles of a common double leaf door hinge. In a preferred embodiment, four knuckles are provided. Suitably, fewer or a greater number of knuckles may be provided and fall within the scope of the invention. The number of the instrument's knuckles is preferably even so that leaf components which they support may counter-rotate end knuckles with respect to each other.

A further structural component of the instant inventive writing instrument comprises a tube member and scribing means combination. In the preferred embodiment, the annular or cylindrical outer periphery of the tube member is fitted for sliding insertion into and through the aligned bores of the plurality of knuckles. Also in the preferred embodiment, the scribing means comprise a marker such as a pencil, a ballpoint pen, a felt-tipped marker, or a paint pen, such scribing means preferably being tubularly configured and fitted for extension in the manner of a quill and shaft combination into the hollow bore of the tube. Upon extension of the tube and scribing means combination through the aligned bores of the knuckles, such combination may effectively facilitate relative counter-rotating movements of the knuckles in the manner of a common hinge pin.

Further structural components of the instant inventive writing instrument comprise first and second leaves which are fixedly attached to or are formed wholly with the knuckles, such leaves being mounted to the knuckles in a manner similar to the mountings of leaves upon the knuckles of the common double leaf hinge. In a preferred embodiment, the leaves are configured so that upon pivoting circumferential motions of the leaves to an opened writing use position, the cross sectional shape of the writing instrument becomes substantially triangular for facilitating secure holding and ergonomic writing. Opposite pivoting of the writing instrument's leaves to bring their distal ends together advantageously reconfigures the instrument for collapsed and compact storage.

In a preferred embodiment, the instant inventive writing instrument further comprises means for alternately longitudinally extending the tube and scribing means combination from a longitudinal end of the knuckles and oppositely-longitudinally retracting such combination. While such extending and retracting means may suitably comprise a common ballpoint pen click actuator, the tube and knuckles are preferably specially configured so that pivoting motions of the leaves actuate the extensions and retractions of the scribing elements. Incorporation of a helical slide channel and slide ridge linear motion actuator at the annular junctures of the tube and the knuckles' bores may advantageously longitudinally move the scribing element upon opening of the leaves, and may oppositely retract the scribing element upon the leaves' closure.

Accordingly, objects of the instant invention include the provision of a writing instrument which incorporates structures, as described above, and which arranges those structures in relation to each other in manners described above, for achievement of the advantages and benefits described above.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENT

Figure 1:
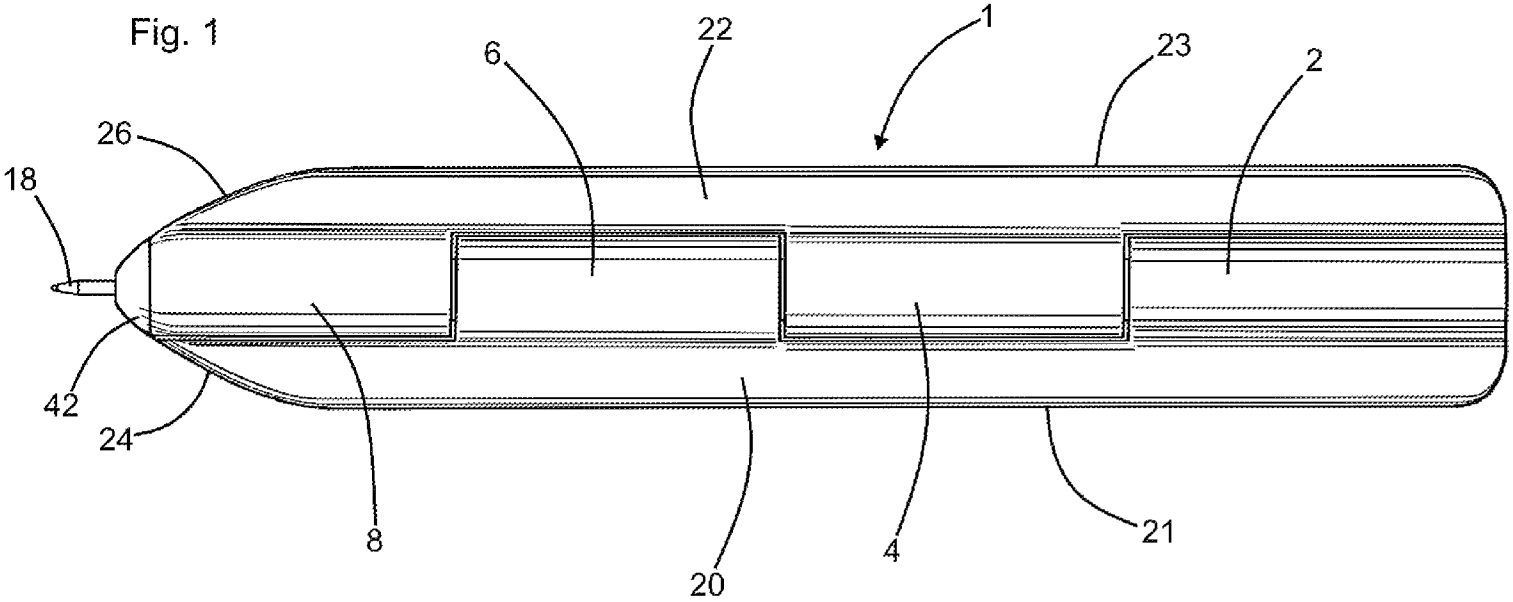
FIG. 1 is a side view of the instant inventive writing instrument, the view showing body leaf components pivoted to their opened positions.
Figure 3:
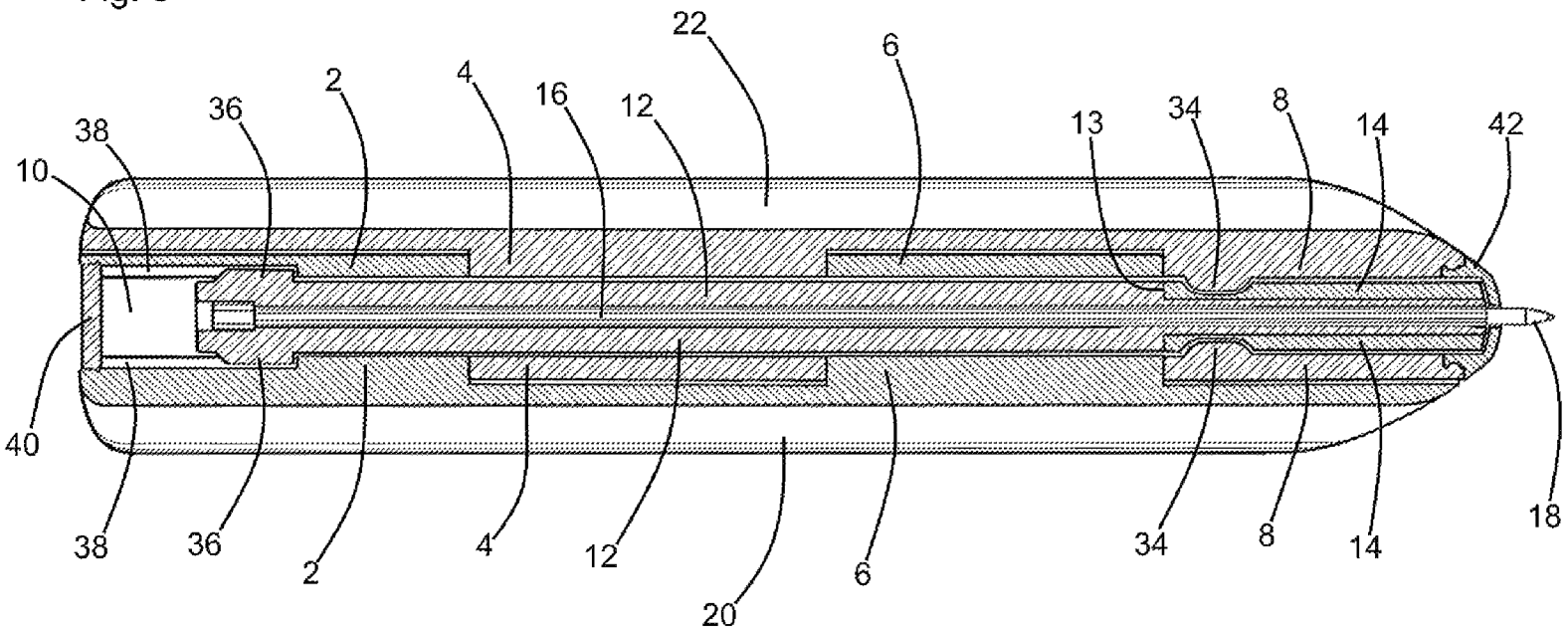
FIG. 3 is a sectional view as indicated in FIG. 2.

Referring now to the drawings and in particular to Drawing FIG. 1, a preferred embodiment of the instant inventive writing instrument is referred to generally by Reference Arrow 1. Knuckles 2, 4, 6, and 8 are preferably configured as cylindrical sleeves in a shape and functional manner common to the central knuckle components of a double leaf door hinge. Referring further simultaneously to FIG. 3, upon an alignment of knuckles 2, 4, 6, and 8 in the manner depicted, a common longitudinally extending bore 10 extending through such knuckles is advantageously formed. The bore 10 preferably comprises each of the bores of the knuckles 2, 4, 6, and 8.

Referring further simultaneously to FIGS. 1 and 3, in order to allow the aligned knuckles 2, 4, 6, and 8 to facilitate pivoting movement of supported components in the manner of a leaf hinge, a tube member and scribing means combination preferably extends longitudinally through bore 10, such combination there functioning similarly with a common hinge pin. In a preferred embodiment, the tube member and scribing means combination comprises a radially outer tube 12,14 and a colorant cartridge 16 which is nestingly received within and extends through the bore of the outer tube 12,14. The colorant cartridge 16 is intended as being representative of other commonly known scribing or writing utensils such as pencils, and the colorant cartridge may suitably contain, store, and dispense common surface printing fluids such as ink, paint, and water color. Where the colorant contained within the cartridge 16 comprises ink, a ballpoint pen tip 18 may be advantageously mounted in communication with the longitudinal end of cartridge 16.

Figure 2:
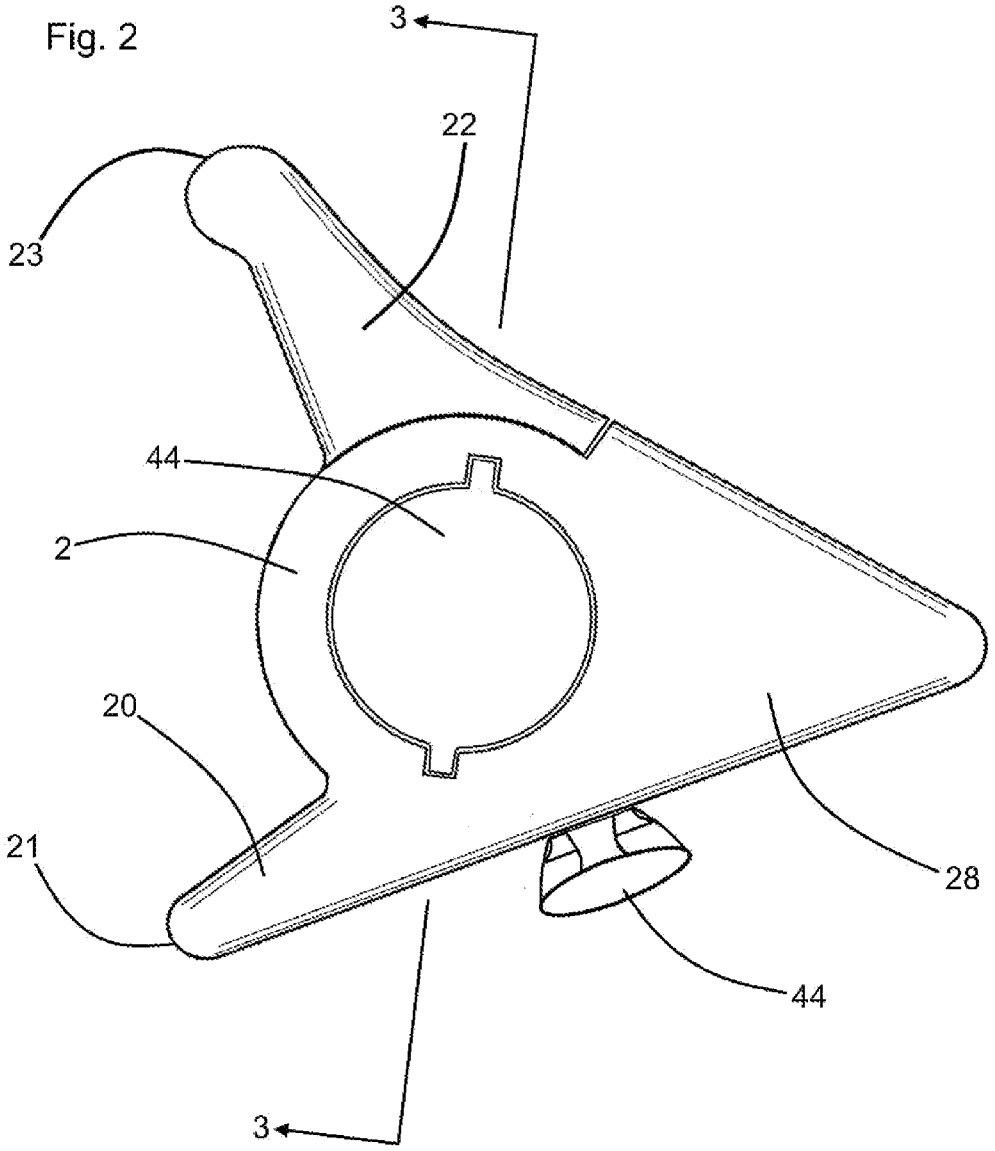
FIG. 2 is a base end or oppositely-longitudinal end view of the structure of FIG. 1.

Referring simultaneously to FIGS. 1-3, the instant inventive writing instrument preferably further comprises first and second leaves 20 and 22. The first leaf 20 is preferably fixedly attached to or formed wholly both with the oppositely-longitudinalmost with knuckle 2 and with knuckle 6, while the second leaf 22 is similarly fixedly attached to or formed wholly both with the longitudinalmost knuckle 8 and with knuckle 4. Leaves 20 and 22 may freely pivot about tube 12,14 between the openend writing use positions represented by Drawing FIGS. 1, 2, and 3, and the closed compact storage positions represented by Drawing FIGS. 4, 5, and 6. The longitudinal ends of leaves 20 and 22 preferably present sloped surfaces 24 and 26 for facilitating ergonomic writing while the leaves are at their opened positions. Also preferably, the proximal end of leaf 20 is configured present a counter-distal extension 28. Upon pivoting of leaves 20 and 22 to their opened position, the lateral cross-sectional shape of the writing instrument as defined by distal ends 21 and 23 and by the counter-distal extension 28 is substantially triangular. Such triangular cross-sectional configuration of the writing instrument 1 further ergonomically assists the user of the instrument during writing.

Figure 4:
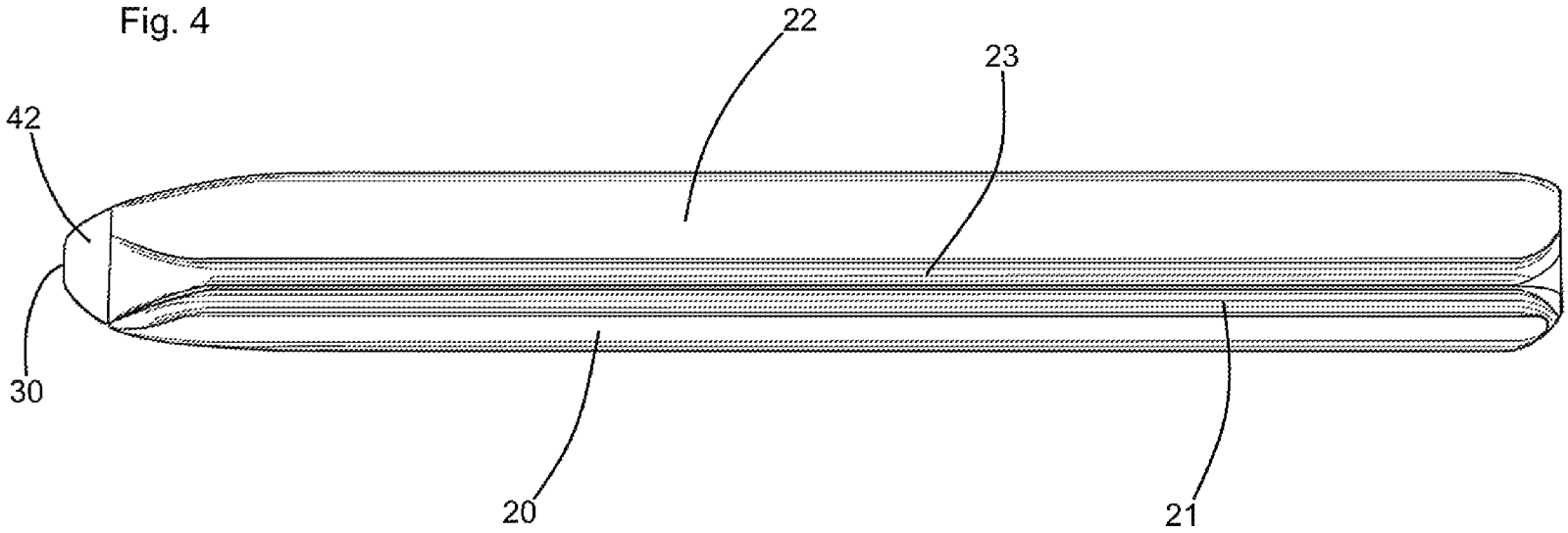
FIG. 4 redepicts the structure of FIG. 1, the view of FIG. 4 showing body leaf components pivoted to their closed positions.
Figure 6:
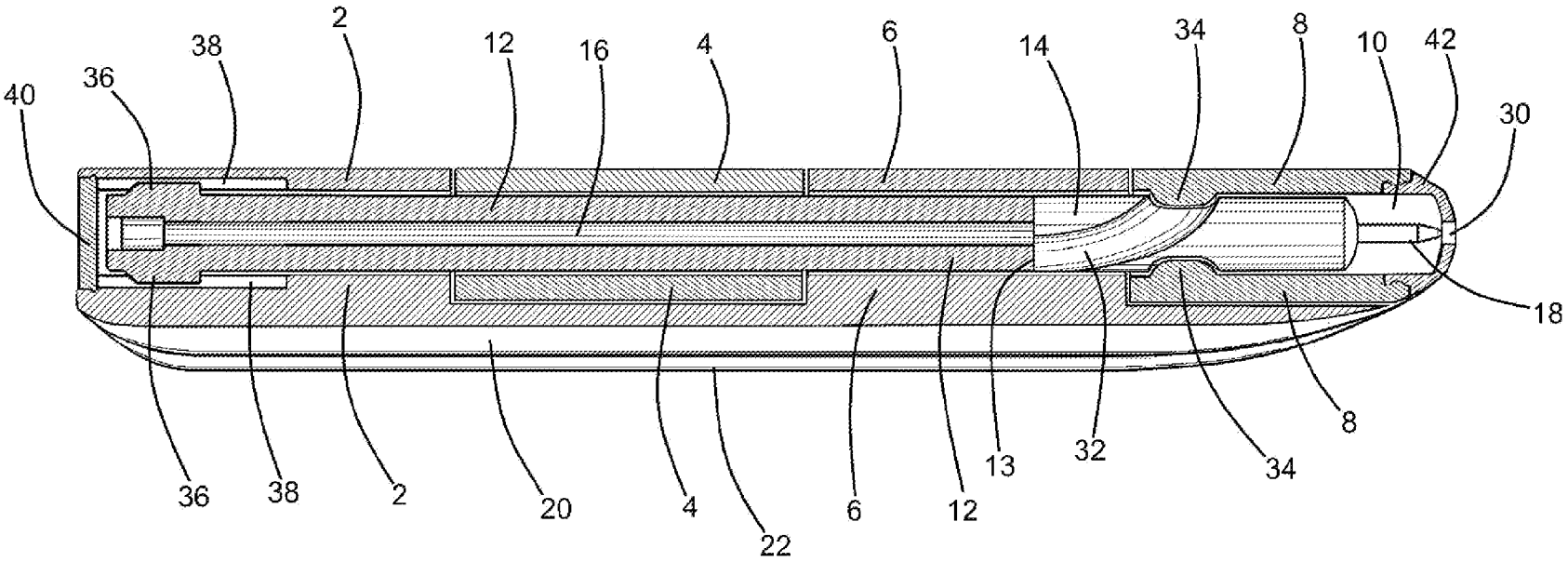
FIG. 6 is a sectional view as indicated in FIG. 5.

Referring simultaneously to all figures, the instant inventive writing instrument 1 preferably incorporates extending and retracting means which are capable of longitudinally extending the tube 12,14, cartridge 16, and pen tip 18 combination with respect to the longitudinal end of the instrument so that pen tip 18 may protrude longitudinally from port 30 of cap 42 as indicated in Drawing FIGS. 1 and 3, and are further capable of oppositely-longitudinally retracting such structures within the bore 10 to the non-writing/storage position represented by Drawing FIGS. 4 and 6.

In the preferred embodiment, such means for longitudinal extension and oppositely-longitudinal retraction comprise a helical slide ridge and slide channel combination as represented in Drawing FIGS. 3 and 6. The slide channels 32 of such combination (the second slide channel being situated at the opposite side of tube segment 14 according to the view of FIG. 6) are preferably helical and are presented at and about the outer surface of a longitudinal segment 14 of the tube member 12,14. The slide ridges 34 may extend radially inwardly from the bore wall of knuckle 8 into bore 10 for engagement within the helical channels 32. Upon pivoting opening motions of leaves 20 and 22 with respect to each other from the FIG. 6 configuration to the FIG. 3 configuration, longitudinally facing surfaces of the slide ridges 34 bias against the sloped oppositely-longitudinally facing walls of the helical slide channels 32, such contact tending to slidably move the tube 12,14 (along with attached cartridge 16 and pen point 18 components) longitudinally within knuckle bore 10, such motion longitudinally protruding the pen point 18 from port 30. In order to facilitate longitudinal reciprocating motions of the tube, cartridge, and pen tip components 12,14,16,18 within bore 10 while preventing any screw actuated rotation of such components, the oppositely-longitudinal end of tube 12 preferably presents slide ridges 36 which are nestingly and slidably received within slide channels 38 formed within the instrument's first or oppositely-longitudinalmost knuckle 2. Accordingly, ridges and channels 36 and 38 operatively engage leaf 20 for rotation stopping while ridges 34 and channels 32 operatively engage leaf 22 for extension and retraction. Such ridge and channel engagements advantageously allow pivoting and counter-pivoting motions of the leaves 20 and 22 with respect to each other to longitudinally reciprocatingly move the instrument's scribing elements.

In assembling the instant inventive writing instrument 1, knuckles 2, 4, 6, and 8 may be interstitially arranged with respect to each other as indicated in FIG. 3 so that the knuckle bore 10 becomes longitudinally aligned. Thereafter, with end caps 40 and 42 initially removed, tube 12 including its nestingly mounted cartridge 16 may be inserted longitudinally through bore 10 until slide ridges 36 engage slide channels 38 of the first or oppositely-longitudinalmost knuckle 2. Thereafter, the longitudinal segment 14 of tube 12,14 may be oppositely-longitudinally inserted into the bore of the second or longitudinalmost knuckle 8, such insertion causing slide ridges 34 to enter helical slide channels 32 from those channels openings at the oppositely-longitudinal end of tube segment 14. Extension of segment 14 continues until such oppositely-longitudinal end abuts and is stopped by a longitudinally facing land 13 of tube 12. A liquid adhesive is preferably applied to the bore wall of segment 14 immediately prior to such oppositely-longitudinal insertion, such adhesive subsequently hardening, and advantageously causing tube members 12 and 14 to comprise the solid and unitary tube component 12,14. Following such assembly and installation of tube and scribing element components, end caps 40 and 42 may be snapped into place as indicated in Drawing FIGS. 3 and 6.

Figure 5:
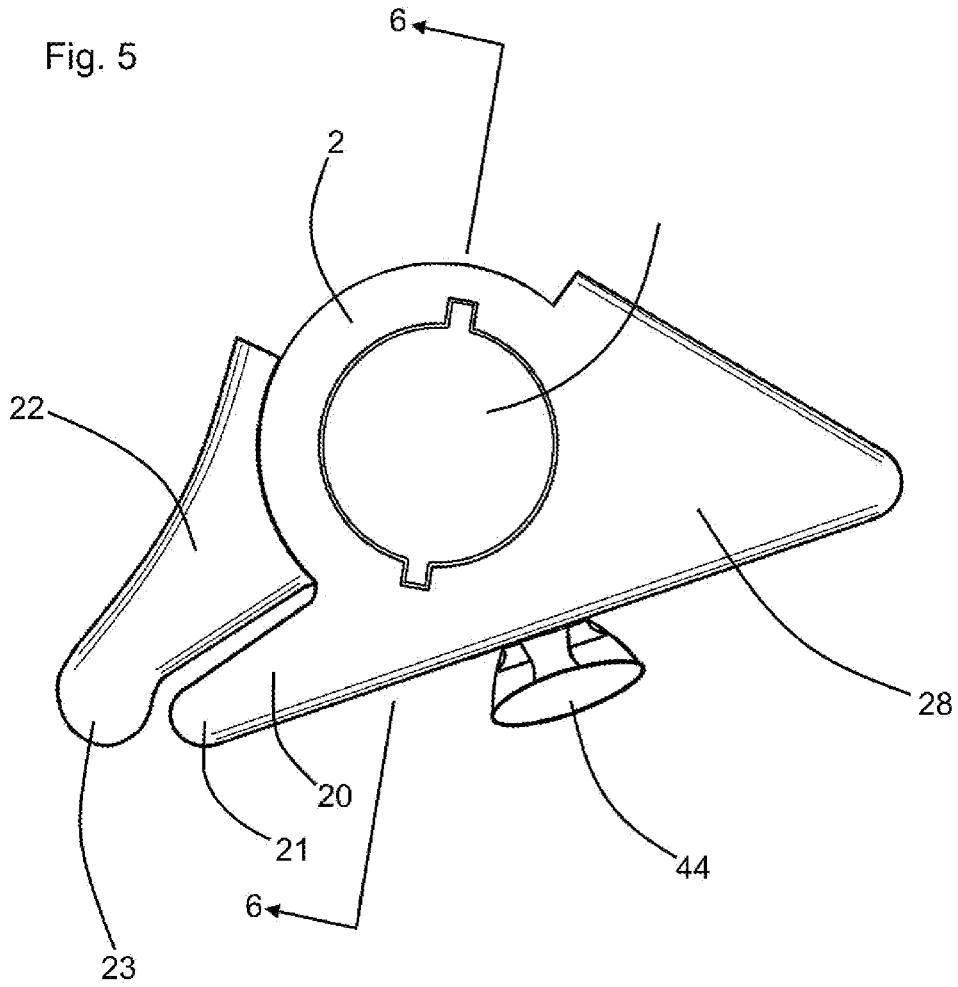
FIG. 5 redepicts the structure of FIG. 2, the view of FIG. 5 showing body leaf components pivoted to their closed positions.

In use of the instant inventive writing instrument 1, the distal ends 21 and 23 of pen body leaves 20 and 22 may be initially positioned substantially adjacent each other by pivoting the leaves 20 and 22 circumferentially or orbitally toward each other to their closed positions as depicted in FIGS. 4, 5, and 6. Upon such initial configuration, pen point 18 is advantageously retracted within bore 10, and the body of the instrument 1 is compactly collapsed for convenient storage. The compact closed configuration of the instrument 1 advantageously facilitates storage within a shirt pocket (not depicted within views), with attached pocket clip 44 engaging a pocket edge.

Opposite circumferential movement of the distal ends 21 and 23 of leaves 20 and 22 from the storage configuration of FIGS. 4-6 to the use configuration of FIGS. 1-3 advantageously orbitally moves ridges 34 about tube 12,14 while such ridges remain nestingly received within helical slide channels 32. Such orbiting engagement of ridges 34 causes pen point 18 to longitudinally extend from port 30 within cap 42. During such extension, the ridge and slide channel combination 36,38 at the oppositely-longitudinal end of the instrument resists rotation of the tube 12,14. Upon completion of such extension, the combined engagements of ridges 34 and 36 with channels 32 and 38 preserves the longitudinal extension of pen point 18 against the oppositely-longitudinally directed counter-pressure of a writing surface against the pen point 18.

The ergonomically triangular cross-sectional shape of the instrument is manually preserved during handwriting use of the instrument 1 by the fingers of a user's hand. Normal finger pressure exerted during writing against leaves 20 and 22 and against their longitudinal edges 24 and 26 mechanically preserves the extended orientation of pen point 18 through the combined actions of slide ridge and slide channels 36 and 38, and slide ridge and slide channels 34 and 32. Repeated opening and closings of leaves 20 and 22 advantageously repeatedly and simultaneously extends and retracts pen point 18.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

The invention claimed is:

1. A writing instrument comprising:

(a) a plurality of knuckles arranged in a longitudinal series;

(b) a tube and scriber combination wherein the scriber comprises a colorant carrying cartridge, said combination extending through the knuckles, said combination's scriber being mounted within the tube and having a longitudinal scribing end;

(c) first and second leaves, each leaf among the first and second leaves having proximal and distal ends, the first and second leaves being connected operatively to the knuckles for movement between closed and opened positions, the distal ends being adjacent each other upon movements of the first and second leaves to their closed positions, the distal ends being displaced circumferentially from each other upon movements of the first and second leaves toward their opened positions; and (d) a screw actuator assembly adapted for alternately longitudinally extending the tube and scriber combination with respect to the knuckles and for oppositely longitudinally retracting said combination, said assembly being connected operatively to the tube, wherein a first knuckle among the plurality of knuckles is fixedly attached to or formed wholly with the first leaf, wherein a second knuckle among the plurality of knuckles is fixedly attached to or formed wholly with the second leaf, and wherein the screw actuator assembly comprises first and second slide ridge and slide channel combinations, the second slide ridge and slide channel combination's slide channel being helical, and wherein the second slide ridge and slide channel combination is adapted for actuating the tube and scriber combination's longitudinal extension upon movement of the first and second leaves toward their opened positions, and is adapted for alternately actuating the tube and scriber combination's oppositely longitudinal retraction upon movement of the first and second leaves toward their closed positions.

2. The writing instrument of claim 1 wherein the second slide ridge and slide channel combination's slide channel opens radially outwardly from the tube and scriber combination's tube and wherein said combination's slide ridge extends radially inwardly from the second knuckle.

3. The writing instrument of claim 2 wherein the first slide ridge and slide channel combination's slide channel opens radially inwardly at the first knuckle.

4. The writing instrument of claim 3 wherein the second knuckle is spaced longitudinally from the first knuckle.

5. The writing instrument of claim 4 wherein the first and second knuckles are respectively oppositely longitudinalmost and longitudinalmost knuckles among the plurality of knuckles.

6. The writing instrument of claim 5 further comprising first and second caps respectively mounted over ends of the first and second knuckles.

7. A writing instrument comprising:

(a) a plurality of knuckles arranged in a longitudinal series;

(b) a tube and scriber combination extending through the knuckles, said combination's scriber being mounted within the tube and having a longitudinal scribing end;

(c) first and second leaves, each leaf among the first and second leaves having proximal and distal ends, the first and second leaves being connected operatively to the knuckles for movement between closed and opened positions, the distal ends being adjacent each other upon movements of the first and second leaves to their closed positions, the distal ends being displaced circumferentially from each other upon movements of the first and second leaves toward their opened positions, wherein, upon movements of the first and second leaves to their opened positions, the writing instrument's lateral cross-sectional shape becomes substantially triangularly configured.

* * * * *